United States Patent [19]

Macdonell et al.

[11] Patent Number: 4,537,690

[45] Date of Patent: Aug. 27, 1985

[54] AQUEOUS METALWORKING COMPOSITION CONTAINING 2-HYDROXYETHYL-(3-CHLORO-2-HYDROXYPROPYL)SULFIDE

[75] Inventors: Gary D. Macdonell; Merlin R. Lindstrom; Bernard A. Baldwin; Rector P. Louthan; Alexander D. Schuettenberg, all of c/o Ste. 1107, 1825 K St. N.W., Washington, D.C. 20006

[73] Assignee: Phillips Petroleum Co., Bartlesville, Okla.

[21] Appl. No.: 641,652

[22] Filed: Aug. 17, 1984

[51] Int. Cl.[3] ..... C10M 3/24; C10M 3/32

[52] U.S. Cl. ..... 252/48.4; 252/49.3; 72/42

[58] Field of Search ..... 252/48.4, 49.3; 568/46, 568/56; 72/42

[56] References Cited

U.S. PATENT DOCUMENTS

| | | | |
|---|---|---|---|
| 3,748,364 | 7/1973 | Tesoro | 568/32 |
| 3,799,875 | 3/1974 | Rohde | 252/48.8 |
| 4,209,410 | 6/1980 | Baldwin | 252/48.2 |
| 4,394,276 | 7/1983 | Small, Jr. | 252/32.7 E |

*Primary Examiner*—Jacqueline V. Howard
*Attorney, Agent, or Firm*—A. W. Dumphlett

[57] ABSTRACT

A metalworking composition containing 2-hydroxyethyl-(3-chloro-2-hydroxypropyl)sulfide in an aqueous medium. A method for enhancing the extreme pressure lubricating properties of an aqueous metalworking composition by admixing therein 2-hydroxyethyl-(3-chloro-2-hydroxypropyl)sulfide.

8 Claims, No Drawings

AQUEOUS METALWORKING COMPOSITION CONTAINING 2-HYDROXYETHYL-(3-CHLORO-2-HYDROXYPROPYL)SULFIDE

BACKGROUND OF THE INVENTION

This invention relates to metalworking compositions. In one of its aspects this invention relates to aqueous metalworking compositions. In still another of its aspects this invention relates to extreme pressure (EP) lubricant additives for aqueous metalworking compositions.

Metalworking fluids—such as fluids used in grinding, machining, and cutting—require good extreme pressure (EP) lubricating properties. Generally, the base fluids used in metalworking have little EP character. The extreme pressure properties are provided by the use of additives.

Other important characteristics of metalworking compositions are provided by other additives so that, typically, the composition will contain small amounts of at least one extreme pressure additive, lubricity additive, rust controlling additive, pH buffering additive, corrosion inhibitor, and biocide, among others. Among the components that make up a metalworking composition, it is the extreme pressure agent that provides the composition with the definitive characteristic of a lubricant suitable for cutting, grinding, or machining metal. The present invention provides an EP agent that is effective and compatible with other commonly used components.

It is therefore an object of this invention to provide a metalworking composition containing an effective extreme pressure lubricating agent. It is another object of this invention to provide a method for enhancing the extreme pressure lubricating properties of a metalworking composition by the addition of a specific additive. In its broadest aspect, however, this invention is interested in providing an effective metalworking composition and a method for improving the effectiveness of metalworking compositions.

Other aspects, objects and the various advantages of this invention will become apparent upon study of this specification and the appended claims.

STATEMENT OF THE INVENTION

In accordance with the invention a metalworking composition is provided which contains an effective amount of an extreme pressure (EP) lubricating agent, 2-hydroxyethyl-(3-chloro-2-hydroxypropyl)sulfide in an aqueous medium.

In another embodiment of the invention a method is provided for enhancing the extreme pressure lubricating properties of a aqueous metalworking composition by admixing therein an effective amount of 2-hydroxyethyl-(3-chloro-2-hydroxypropyl)sulfide.

The 2-hydroxyethyl-(3-chloro-2-hydroxypropyl)sulfide useful as an additive in the present invention can be prepared by reaction of 2-mercaptoethanol with epichlorohydrin.

2-Hydroxyethyl-(3-chloro-2-hydroxypropyl)sulfide is effectively used as an EP agent in metalworking compositions in a relatively small amount. The metalworking compositions are best prepared as a concentrate containing an effective amount up to about 15 weight percent, preferably from about 5 to about 10 weight percent of the additive in an aqueous medium. 2-Hydroxyethyl-(3-chloro-2-hydroxypropyl)sulfide, in contrast to other well-known EP agents including its homologs, is water-soluble which permits the use of this compound in metalworking compositions without addition of an emulsifier. In actual use the concentrate is diluted with additional water in an amount and a range of about 5:1 to about 40:1 of water to concentrate depending on the type of metalworking application in which the composition is being used.

The metalworking composition will typically contain effective amounts of compounds useful for increasing lubricity, adjusting pH, inhibiting rust, inhibiting corrosion, as biocide, controlling bacterial and fungal growth or to give other useful properties to the composition. When these components are present in the concentrated composition an effective amount will generally fall within the range of about 5 to about 10 weight percent lubricity additive, about 5 to about 10 weight percent pH adjusting compound, about 1 to about 5 weight percent rust inhibitor, about 1 to about 5 weight percent corrosion inhibitor, and about 0.10 to about 1.0 weight percent biocide.

Note that upon dilution of the concentrated metalworking composition that a preferred range of additive concentration will follow the range of about 0.001 to about 2.5 percent for the EP additive of this invention, about 0.1 to about 2 percent for lubricity additives, about 0.1 to about 2 percent for pH adjusting additive, about 0.02 to about 1 percent for rust inhibiting additive, about 0.02 to about 1 percent for corrosion inhibiting additive, about 0.002 to about 0.2 percent for biocide, all percents being weight percent based to the total final composition.

The preparation of the compositions of this invention is by the admixing of additives in aqueous solution in any order of additives required for a particular purpose. All components are generally water-soluble and, in fact, aside from the EP additive of this invention, other components of the metalworking composition can be chosen from any of the compounds well-known in the art to be useful and effective for providing specific, desirable properties to the metalworking composition. The specific choice of other components of the composition is not critical to the present invention.

The following examples set out the usefulness of the present invention. These examples should be taken as illustrative and not as restrictive.

In the following examples a base concentrate of metalworking composition was prepared generally using distilled water and various additives useful for specific purposes. Among the additives used were the following:

2-hydroxyethyl-(3-chloro-2-hydroxypropyl)sulfide, the EP pressure agent of this invention, triethanolamine, for pH adjustment, Synkad 500, a carboxylic acid salt rust inhibitor available from Keil Chemical Division of Ferro, 3000 Sheffield Avenue, Hammond, Ind. 46320.

Bioban P-1487, a biocide available from Keil Chemical,

Inversol 170, a lubricity agent available from Keil Chemical,

EM-550, a lubricity agent available from Keil Chemical.

The mixing was done at room temperature with standard mixing equipment.

Example I

To illustrate the effectiveness of 2-hydroxyethyl-(3-chloro-2-hydroxypropyl)sulfide as an EP agent a saw test was run on a Racine Oil Cut Power Hacksaw, made by Racine Tool and Machine Company, Racine, Wisc. Two solutions were compared during one test run. For each solution there was a two-gallon reservoir maintained at 50° C. A stainless steel drip pan permitted the cutting fluid to flow back into the reservoir. The same saw blade was used throughout the test which generally consisted of making about 62 cuts in a piece of 1.25 inch bar stock (304 stainless steel). The fluid used in the cutting operation was alternated between the two test solutions as was the drip pan which redirected the fluid into the reservoir. Cutting fluid was switched after the 7th cut and after every 5 additional cuts. Cutting time was measured and plotted vs. the cut number for each solution. A cutting trend line was then plotted for each of the two solutions. If the trend line of fluid A was below that of fluid B, fluid A was judged to be superior in cutting ability.

Formulations for two solutions which were then compared to the solutions plus 2-hydroxyethyl-(3-chloro-2-hydroxypropyl)sulfide are set out below. The amounts of compositions are in weight percent.

| Solution A | Solution B |
|---|---|
| 0.8% Inversol 170 | 0.8% EM-550 |
| 0.8% Triethanolamine | 0.8% Triethanolamine |
| 0.3% Synkad 500 | 0.3% Synkad 500 |
| 0.05% Bioban P-1487 | 0.05% Bioban P-1487 |
| Balance Distilled Water | Balance Distilled Water |

Each of the solutions was compared against a similar solution otherwise the same but also containing 0.8 weight percent 2-hydroxyethyl-(3-chloro-2-hydroxypropyl)sulfide. By graphical analysis of the saw test as outlined above, a comparison of the trend lines taken at cut 33-34 as analyzed to give the following results:

TABLE I

| Base Solution | Cut Time Base Solution | Cut Time, Base Solution Plus 2-hydroxyethyl-(3-chloro-2-hydroxypropyl)sulfide | % Reduction in Cut Time |
|---|---|---|---|
| A | 183 seconds | 175 seconds | 4.4 |
| B | 163 seconds | 147 seconds | 16 |

It can be seen from the table that the use of the EP agent of the present invention provided a reduction in cut time as compared to the same base solution without the EP additive.

EXAMPLE II

Products wear testing according to ASTM D-2670 was carried out with the two following modifications to the ASTM standard:

(1) testing was done at 2000 lbs. load, and (2) at the end of each minute of testing of the test load, the load was backed off 20–50 lbs. and the gear allowed to ratchet up to the test load. The starting test temperature was 50° C. The torque and teeth number were recorded and the resulting cumulative wear numbers are recorded in Table II.

The formulation for a base solution which was then compared to the solution plus 2-hydroxyethyl-(3-chloro-2-hydroxypropyl)sulfide is set out below. The amounts of component are in weight percent.

| Base Solution C |
|---|
| 8% Inversol 170 |
| 8% Triethanolamine |
| 3% Synkad 500 |
| 0.5% Bioban P-1487 |
| Balance Distilled Water |

The base solution was compared against a similar solution otherwise the same but also containing 8 weight percent 2-hydroxyethyl-(3-chloro-2-hydroxypropyl)-sulfide. Each of these concentrated solutions was diluted at the ratio of 9 parts distilled water to 1 part concentrate before being used in the wear test.

TABLE II

| Time, Min. | Teeth Wear Base Solution | Teeth Wear Inventive Solution |
|---|---|---|
| 0 | 7 | 4 |
| 1 | 103 | 12 |
| 2 | 190 | 22 |
| 3 | 268 | 34 |
| 4 | 381 | 43 |
| 5 | Failed | 54 |
| 6 | | 63 |
| 7 | | 67 |
| 8 | | 73 |
| 9 | | 77 |
| 10 | | 82 |
| 11 | | 86 |
| 12 | | 93 |
| 13 | | 97 |
| 14 | | 99 |
| 15 | | 103 |

It can be readily seen that the performance of the base solution plus the EP additive was superior to that of the solution without the additive.

We claim:

1. A metalworking composition comprising an extreme pressure effective amount of 2-hydroxyethyl-(3-chloro-2-hydroxypropyl)sulfide with an effective amount of (1) lubricity additive, (2) pH adjusting compound, (3) rust inhibitor and (4) biocide in an aqueous medium.

2. A concentrated metalworking composition of claim 1 comprising about 5 to about 10 weight % 2-hydroxyethyl-(3-chloro-2-hydroxypropyl)sulfide, about 5 to about 10 weight % lubricity additive, about 5 to about 10 weight % compound for adjusting pH, about 1 to about 5 weight % rust inhibitor, and about 0.1 to about 1.0 weight % biocide in an aqueous medium.

3. A metalworking composition comprising said concentrate of claim 1 diluted with water in an amount in a range of about 5:1 to 40:1 of water to concentrate.

4. A metalworking composition comprising said concentrate of claim 2 diluted with water in an amount in a range of about 5:1 to about 40:1 of water to concentrate.

5. A method for enhancing the extreme pressure lubricating properties of an aqueous metalworking composition comprising an effective amount of lubricity additive, pH adjusting compound, rust inhibitor, and biocide said method comprising admixing therein an effective amount of 2-hydroxyethyl-(3-chloro-2-hydroxypropyl)sulfide.

6. A method for enhancing the extreme pressure lubricating properties of a metalworking composition concentrate comprising a lubricity additive in an amount of about 5 to about 10 weight %, a pH additive adjusting compound in an amount of about 5 to about 10 weight %, a rust inhibitor in an amount of about 1 to about 5 weight %, and biocide in an amount of about 0.1 to about 1.0 weight % of the total composition, said method comprising admixing therein about 5 to about 10 weight % of 2-hydroxyethyl-(3-chloro-2-hydroxypropyl)sulfide.

7. A method for providing a metalworking composition comprising further diluting the concentrate obtained by the method of claim 1 by the addition of water in amount in the range of about 5:1 to about 40:1 of water to concentrate.

8. A method for providing a metalworking composition comprising further diluting the concentrate obtained by the method of claim 6 by the addition of water in amount in the range of about 5:1 to about 40:1 of water to concentrate.

* * * * *